United States Patent [19]

Rome

[11] Patent Number: 4,921,114

[45] Date of Patent: May 1, 1990

[54] CHILD'S SNACK CARRIER

[76] Inventor: Brenda J. L. Rome, 1314 Cloud Cir., Garden City, Kans. 67846

[21] Appl. No.: 273,044

[22] Filed: Nov. 18, 1988

[51] Int. Cl.[5] ..... B65D 6/02; B65D 41/62; B65D 25/28

[52] U.S. Cl. ..... 220/4 B; 220/212; 220/254; 220/94 R

[58] Field of Search ..... 220/4 B, 4 E, 212, 254, 220/352, 355, 94 R

[56] References Cited

U.S. PATENT DOCUMENTS

| | | | |
|---|---|---|---|
| D. 11,667 | 3/1880 | Warner . | |
| D. 66,278 | 7/1921 | De Rosa . | |
| D. 88,438 | 9/1932 | Patten . | |
| D. 112,606 | 9/1938 | Kato . | |
| D. 149,963 | 3/1947 | McCarthy . | |
| D. 176,825 | 1/1956 | Sacia et al. . | |
| 216,831 | 6/1879 | Collings | 220/4 B |
| D. 287,205 | 12/1986 | Uglow . | |
| D. 287,206 | 12/1986 | Ohtake . | |
| 2,338,397 | 1/1944 | Bealsley | 220/4 B |
| 2,736,452 | 2/1956 | Roop | 220/4 B |
| 2,780,385 | 2/1957 | Tupper | 220/352 |
| 3,051,303 | 7/1960 | Daanen et al. . | |
| 3,123,246 | 3/1964 | Spinoza | 220/212 |
| 3,307,602 | 5/1964 | Boster . | |
| 3,680,828 | 8/1972 | Swett | 220/355 |

FOREIGN PATENT DOCUMENTS

| | | | |
|---|---|---|---|
| 771133 | 10/1972 | Belgium | 220/4 B |
| 680795 | 8/1939 | Fed. Rep. of Germany | 220/4 B |
| 999375 | 1/1952 | France | 220/4 B |

*Primary Examiner*—George E. Lowrance

*Attorney, Agent, or Firm*—Kokjer, Kircher, Bradley, Wharton, Bowman & Johnson

[57] ABSTRACT

A carrier for snack items for a small child has top and bottom dish shaped concavo-convex members releasably secured together near the mid-line of the carrier to present a bulbous shape defining an internal cavity. Food items placed in the carrier are accessible to the child through an opening in the top and the opening is located and sized to minimize the chance for spillage when the child carries the container in hanging fashion from one of a pair of U-shaped handles. A cover is releasably secured to a flange surrounding the access opening and the cover can be releasably parked on a similar flange on the bottom of the carrier when the latter is in use.

10 Claims, 1 Drawing Sheet

CHILD'S SNACK CARRIER

This invention relates to containers and more particularly to a container especially suitable for snack items to be carried by a small child.

Small children, particularly those of toddler age, often require nourishment in addition to that provided them at regular meal times. Snacks such as prepared dry cereal products are frequently used for this purpose.

Children of this age usually have not yet developed the dexterity required for manipulating containers of the type commonly used for dispensing snack items to older children or to adults. Open topped containers such as dishes or the like are rather quickly upset by small children and the contents spilled. Packages containing snack items such as prepared dry cereals present obstacles to convenient access by children of toddler age or are subject to spillage or both. Neither open topped receptacles nor cartons are well suited for carrying by small children. Portability is very desirable to provide snacks to highly active children of this age.

It is, therefore, a very important object of this invention to provide a container which may be easily used by small children to provide access to materials such as food items or the like.

Another very important object of the present invention is to provide a container for items of this general type which container may be easily manipulated by relatively small children.

Still another important aim and objective of this invention is to provide a container which is readily portable and lends itself to easy carrying by small children. A yet further object of the present invention is to provide a container which is not likely to spill its contents even when handled awkwardly or dropped.

Still another object of the invention is to provide a container which is not subject to breakage from rough handling, yet which is readily separable into its respective halves for cleaning and to provide versatility for use by older, more dexterous children.

These and other important aims and objectives of the present invention will be further explained or will be apparent from the following description and explanation of the drawing.

Figure 2:
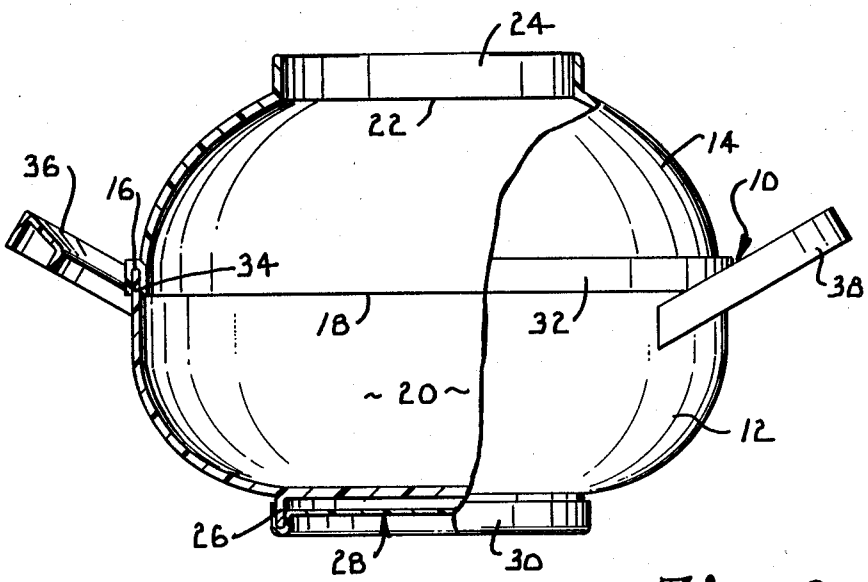
FIG. 2 is a front elevational view of the carrier of FIG. 1, parts being broken away and shown in cross-section to reveal details of construction.

A carrier or dispenser embodying the principles of this invention is broadly designated in the drawings by the reference numeral 10. The carrier is comprised of a pair of bowl or dish shaped members 12 and 14 of substantially similar size and oppositely oriented when joined at their respective rims 16 and 18 to conjointly define an internal cavity 20. The rims 16 and 18 of the respective members lie in their respective planes to define a juncture extending peripherally and in a generally horizontal plane at about the mid line of the container when the latter is disposed in its upright position as shown in FIG. 2 of the drawing. In this position, the member 12 serves a base for the dispenser and member 14 is a cover for the base.

An opening 22, preferably coaxial with the vertical axis of dispenser 10, is provided in member 14 to provide access to cavity 20 as will be readily understood. Member 14 includes an integral peripherally extending flange 24 projecting upwardly and outwardly from the outer surface of the member. A similarly shaped, preferably integral flange 26 projects downwardly and outwardly from base member 12 to provide a stand adapted to support the dispenser on a flat surface in the upright position as shown in FIG. 2.

Figure 3:
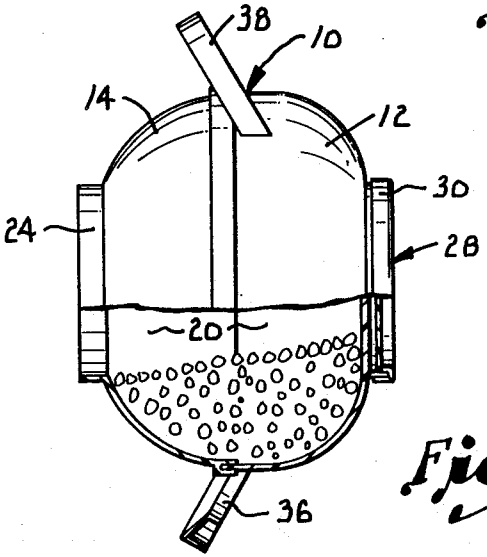
FIG. 3 is a view similar to FIG. 2 but on a reduced scale and showing the carrier in a disposition approximating that of hanging when carried by one of its handles.
Figure 1:
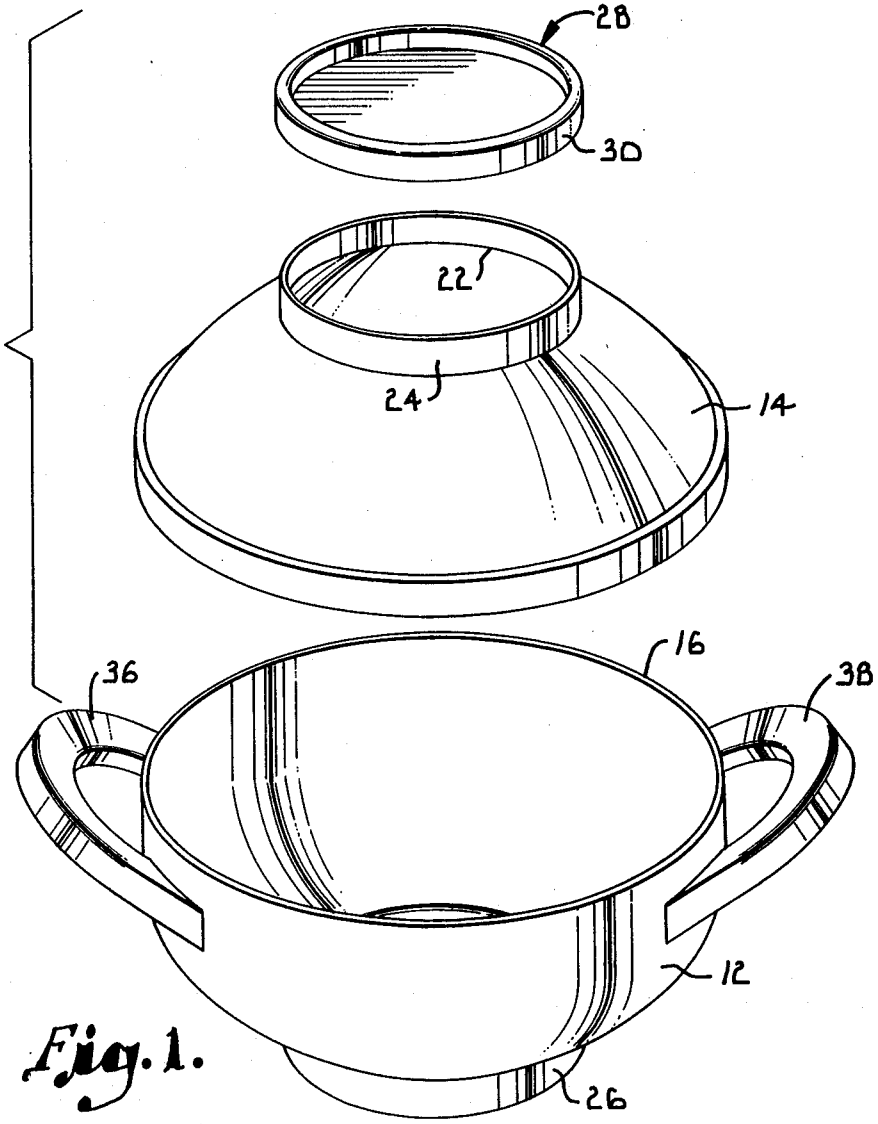
FIG. 1 is an exploded, perspective view of a carrier embodying the principles of this invention.

Flange 26 is shaped substantially identically to flange 24 so that both flanges can, if desired, releasably receive a cover 28 as shown installed on flange 26 in FIGS. 2 and 3 of the drawing. Cover 28 is preferably constructed from yieldable plastic material and is provided with an integral, peripherally extending shirt 30 shaped as shown best in FIG. 2 of the drawing. It will be readily understood that cover 28 has formed therein a peripherally extending, annular, substantially U-shaped slot which can be fitted over flange 26 to releasably retain the cover in the disposition shown in FIG. 2. It will also be readily understood that cover 28 can, when desired, be removed from flange 26 and installed on flange 24 in covering relationship across opening 22 to seal cavity 20.

The dish shaped members 12 and 14 are also preferably constructed from relatively yieldable plastic material and top member 14 has an integral band 32 of increased thickness extending around its peripheral rim 18 as shown best in FIG. 2. Band 32 has an annular, vertically extending, peripheral slot 34 opening downwardly in disposition to receive therein the upwardly directed peripheral rim 16 of base or bottom member 12 as shown in the drawing. This construction provides for the frictional, releasable joinder of the two halves of container 10 so that the respective members may be readily separated for easy access to the interior of the container.

A pair of oppositely directed, upwardly inclined, generally U-shaped handles 36 and 38 are preferably integrally formed on base member 12 near the upper margin of the latter and project outwardly from the container as shown.

In use, container 10 may be partially filled with an item to be given to a small child such as a child of toddler age. It is often desirable that children of this age have access to food items to provide snacks at times other than the regular established meal times. Accordingly, a snack item such as dried prepared cereal may be placed in the container and the latter given to a child.

The container 10 is ideally suited for carrying by a child of this age. The outwardly projecting, substantially U-shaped handles, the bights of which extend generally horizontally as shown in the drawing, are particularly well suited for grasping by such a child. The reflexes of children of this age for grasping are relatively well developed while other reflexes which contribute to manual dexterity are not so well developed at this time. A small child can readily carry the container as it toddles from place to place during the normal activities of such a child.

The container will often be carried by a child in a hanging disposition from one of the handles. The opening 22 defined by flange 24 is spaced along member 14 from the member rim 18 and is preferably located at the extreme top of carrier 10 as has heretofore been explained. This relationship of the opening in conjunction with the bulbous shape of cavity 20 ensures that a substantial portion of the cavity is located below the opening when the carrier is hung from one of its handles. Accordingly, a substantial quantity of snack items can be carried by the child without spilling through the opening as is illustrated in FIG. 3 of the drawing. The child is afforded access to the snack items as it desires through opening 22. The opening may have a diameter only slightly larger than a child's hand, further minimizing the likelihood for spillage.

If it is desired to leave the snack items in the carrier when the latter is not in use, cover 28 can be readily removed from flange 26 and installed on flange 24. This, of course, seals the container until the container is needed for subsequent use.

The construction of carrier 10 comprised of two oppositely facing, concavo-convex dish shaped members with the juncture between the members about midway between the bottom and the top of the carrier minimizes the chances that the carrier will have the contents spilled therefrom even when it is tipped from its true vertical position. The increased thickness near the mid-line of the carrier afforded by band 32 tends to prevent the carrier from tipping to an upended position. Further, the upward and outward inclination of the U-shaped handles tends to ensure that the child will deposit the carrier with its base on a supporting surface when the child releases its grasp on the carrier. This, in turn, tends to ensure against spillage of the contents.

The construction of the carrier from two generally similar halves ensures that the carrier can be easily cleaned and enhances the stackability to minimize volume for storage. Further, when a child achieves greater manual dexterity as it grows older, the base member 12 with its hanldes 36 and 38 can be used by the child without the necessity for cover member 14. The construction from relatively yieldable plastic eliminates the possibility for breakage of the carrier from rough handling or dropping by the child and minimizes the chances that the child might be injured if it should fall on the carrier.

I claim:

1. A dispenser for material comprising:

a pair of oppositely oriented, dish shaped top and bottom members respectively each member having a peripheral rim, said members being releasably fastened together at their respective peripheral rims to conjointly present a hollow, generally globe shape defining an internal cavity;

there being an opening through said top member disposed in spaced apart relationship from the rim of said top member, said opening providing access to the cavity; and a generally U-shaped handle secured to the dispenser and projecting outwardly from the globe shape defined by the members, said handle being oriented with the bight of the handle extending generally horizontally for convenient grasping of said bight to carry the dispenser in disposition hanging from the handle, said opening being spaced substantially above the lowermost region of said cavity when the dispenser is in said hanging disposition, whereby to minimize the possibility for spillage of said items from the cavity through the opening during carrying of the dispenser by the grasped handle bight with the dispenser in said hanging disposition.

2. A dispenser as set forth in claim 1, and a cover for said dispenser, said cover being adapted to be releasably secured to said top member in covering relationship over said opening.

3. A dispenser as set forth in claim 2, wherein said top member is provided with an integral flange projecting outwardly from said top member in circumscribing relationship around said opening, and wherein the cover is provided with an annular lip configured to frictionally engage said top member flange to releasably secure the cover over said opening.

4. A dispenser as set forth in claim 3, wherein said lip is provided with an annular slot, said flange being configured to fit into said slot for releasably securing the cover to the top member.

5. A dispenser as set forth in claim 4, wherein said bottom member is provided with an integral, annular flange projecting outwardly therefrom in disposition to present a stand adapted for supporting the carrier on a supporting surface, and wherein said flange on said bottom member is shaped and of a size substantially similar to the flange of said top member whereby said cover may be releasably installed on said bottom member flange for storage when the cover is removed from its covering position over the opening to provide access to said cavity.

6. A dispenser as set forth in claim 1, wherein said top and bottom members are mutually of generally similar size and wherein the rim of each respective member lies in a plane, the junction of said rims lying in a plane which extends substantially horizontally when the dispenser is in its upright position, the plane at said junction being about midway between the upper and lower extremities of said dispenser.

7. A dispenser as set forth in claim 6, wherein one of said members is provided with an integral band of increased thickness proximal its rim and extending peripherally around the latter, said band being provided with an annular, vertically extending peripheral slot open at one end and adapted to receive therein the rim of said other member for releasably securing the members together.

8. A dispenser as set forth in claim 7, wherein said handle is secured to said bottom member.

9. A portable dispenser to provide a small child with a supply of a food, said dispenser comprising:

a bowl shaped base having an upwardly facing concavity defined by a side wall terminating in an upper peripherally extending edge;

a covering member conjointly define therebetween a cavity adapted to hold a quantity of food items, there being an opening in the covering member to provide access to the food in the cavity; and a generally U-shaped handle secured to the dispenser and projecting outwardly therefrom in disposition to be grasped by said child for carrying the dispenser hanging from the handle, the opening in the covering member being positioned substantially above the lowermost portion of the cavity when the dispenser is hanging from the handle to minimize spillage of food through the opening when the dispenser is carried in said hanging position.

10. A dispenser as set forth in claim 9, wherein said dispenser is provided with a pair of said generally U-shaped handles, each handle being secured to said base and projecting upwardly and outwardly from an opposite side of the dispenser from the other handle.

* * * * *